US007542710B2

(12) United States Patent
Shinkawa et al.

(10) Patent No.: US 7,542,710 B2
(45) Date of Patent: Jun. 2, 2009

(54) CLEANING DEVICE FOR A FIXING UNIT

(75) Inventors: Tatsuya Shinkawa, Nara (JP); Takashi Yamanaka, Yamatokoriyama (JP); Kan Mukai, Yamatokoriyama (JP); Kouji Wakamoto, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 306 days.

(21) Appl. No.: 11/368,999

(22) Filed: Mar. 7, 2006

(65) Prior Publication Data

US 2006/0216076 A1 Sep. 28, 2006

(30) Foreign Application Priority Data

Mar. 25, 2005 (JP) ..... 2005-088149

(51) Int. Cl.
*G03G 15/20* (2006.01)

(52) U.S. Cl. ..... 399/327

(58) Field of Classification Search ..... 399/327
See application file for complete search history.

(56) References Cited

FOREIGN PATENT DOCUMENTS

| | | | |
|---|---|---|---|
| JP | 63014186 A | * | 1/1988 |
| JP | 9-160420 A | | 6/1997 |
| JP | 10123873 A | * | 5/1998 |
| JP | 11095601 A | * | 4/1999 |
| JP | 2004-191406 A | | 7/2004 |
| JP | 2005-196096 A | | 7/2005 |

OTHER PUBLICATIONS

English Translation of Tsujihara (JP 2004-191406).

* cited by examiner

*Primary Examiner*—David M Gray
*Assistant Examiner*—Erika Villaluna
(74) *Attorney, Agent, or Firm*—Nixon & Vanderhye P.C.

(57) ABSTRACT

A fixing unit includes a heat roller and a pressing roller that comes in pressure contact with the heat roller, and passes the recording paper with an unfixed toner image formed thereon through the nip between the heat roller and pressing roller to thereby fix the toner image to the recording paper by applying heat and pressure thereto. A cleaning device for removing the toner remaining on the heat roller or pressing roller in the fixing unit includes cleaning rollers made of metal arranged in press-contact with the heat roller and pressing roller, the peripheral surface of the cleaning rollers being formed with projected and indented shapes to thereby remove the leftover toner appropriately.

3 Claims, 5 Drawing Sheets

CLEANING DEVICE FOR A FIXING UNIT

This Nonprovisional application claims priority under 35 U.S.C. § 119(a) on Patent Application No. 2005-88149 filed in Japan on 25 Mar. 2005, the entire contents of which are hereby incorporated by reference.

BACKGROUND OF THE INVENTION (1) Field of the Invention

The present invention relates to a cleaning device for a fixing unit in an electrophotographic image forming apparatus, the fixing unit being formed of a heating member incorporating a heater and a pressing member that is put in press-contact with the heating member to fix an unfixed developer image formed on the surface of recording paper thereto by applying heat and pressure as the paper is passed through the nip between the heating member and pressing member, and more specifically, relates to a cleaning device for removing the developer remaining on the heating member and/or pressing member in the fixing unit.

(2) Description of the Prior Art

There are known electrophotographic image forming apparatuses, such as electrophotographic copiers, printers, etc., which comprise: a photoreceptor drum (image support) for supporting an unfixed developer image (toner image) that is obtained by developing an electrostatic latent image by a developer (toner); a transfer device for transferring the unfixed developer image on the photoreceptor drum to recording paper; and a fixing unit formed of a heat roller (heating member) heated by a heater such as a heat lamp etc., and a pressing roller (pressing member) abutted with a predetermined contact pressure against the heat roller.

The recording paper to which the unfixed developer image has been transferred by the transfer device is passed through the nip between the heat roller and the pressing roller of the fixing unit with its unfixed developer image surface facing the heat roller, so as to fix the unfixed developer image to the recording paper.

In addition to the image forming apparatuses for monochrome image forming such as black and white and the like, the electrophotographic image forming apparatuses also include color image forming apparatuses for printing color images with multiple colors of developers. In the case of such a color image forming apparatus, multiple colors of developer images are transferred to the recording paper (forming layers of developer images), so that the total thickness of the layers of unfixed developers is prone to be large.

When the total layer of the unfixed developers is thick as above, there may occur the problem with the conventional fixing unit that part of the developers adheres to the heat roller.

To deal with this problem, there has been a proposal of a cleaning device (Japanese Patent Application Laid-open Hei 9-160420) in which a cleaning member made of a felt or resin blade is put in press-contact with or abutted against the heat roller in order to remove the unnecessary developer adhering to the heat roller.

Use of the above cleaning device makes it possible with the cleaning member to collect the unnecessary developer from the heat roller when the fixing unit is in the initial condition, such as immediately after cleanup of the fixing unit, or the like.

However, after a period of a certain use of the image forming apparatus, the cleaning member of the cleaning device becomes dirty with the developer hence will degrade in cleaning performance. If this occurs, the unnecessary developer remains on the fixing rollers (heat roller and pressing roller), and part of the remaining developer may adhere to the recording paper hence spoil or dirty the front and rear sides of the recording paper.

In actual situations, adhesion of the remaining developer (toner) on the fixing rollers to the recording paper occurs such that adhesion of the developer corresponding to the print image information on the fixing rollers transfers to the recording paper when the recording paper passes through the nip between the heat roller and pressing roller (accordingly, the transferred remaining developer is not so conspicuous when it is seen in the printed recording paper).

In this case, the remaining developer on the fixing rollers collects and builds up at and around the contact points of multiple separation claws and a temperature detection sensor with the outer peripheral surfaces of the fixing rollers. When the remaining developer that has built up at these areas separates and drops due to some kind of impact and adheres to the recording paper, the developer is fused and fixed by heat from the heated fixing rollers, producing defects such as smudges or visible spots, etc., on the recording paper (the front and rear surfaces). Thus, the problem of image quality degradation occurs.

SUMMARY OF THE INVENTION

A cleaning device has been developed for a fixing unit which can reliably prevent smudges on the front and rear surfaces of the recording paper by positively removing the remaining developer from the heating and pressing member of the fixing unit, to thereby improve the quality of images formed on the recording paper.

A cleaning device for a fixing unit is provided in an electrophotographic image forming apparatus, the fixing unit being formed of a heating member incorporating a heater and a pressing member that is put in press-contact with the heating member to fix an unfixed developer image formed on the surface of recording paper thereto by applying heat and pressure as the paper is passed through the nip between the heating member and pressing member, the cleaning device for removing the developer remaining on the heating member and/or pressing member in the fixing unit, and includes: a cleaning roller made of metal arranged in press-contact with the heating member or pressing member, the surface of the cleaning roller being formed with a projected and indented shape.

Here, the heating member may be a heat roller incorporating a heater lamp. The pressing member may be a heat roller etc., or may be a pressing belt.

The cleaning roller is preferably formed of a metal such as aluminum, stainless steel, which presents good thermal conductivity and heat resistance.

In the cleaning device for a fixing unit, it is preferred that peripheral devices including a plurality of paper separation claws, a temperature detecting sensor or the like, are arranged on the periphery of the heating member or pressing member, and the projected and indented shape on the peripheral surface of the cleaning roller is configured so that projections are formed at the positions corresponding to the positions of the peripheral devices.

In the cleaning device for a fixing unit, it is preferred that the cleaning roller is laid out on the downstream side of the positions of the multiple paper separation claws arranged on the periphery of the heating member or pressing member, with respect to the direction of surface movement of heating member or pressing member.

In the cleaning device for a fixing unit, it is preferred that the cleaning roller is laid out on the upstream side of the position of the temperature detecting sensor arranged on the periphery of the heating member or pressing member, with respect to the direction of surface movement of the heating member or the pressing member.

In the cleaning device for a fixing unit, it is preferred that the cleaning roller is driven following the drive for the heating member and pressing member.

A metallic cleaning roller is arranged in press-contact with the heating member or the pressing member of the fixing unit. In this case, heat from heater transfers from the heating member surface to the cleaning roller, or from the heating member surface via the pressing member surface to the cleaning roller, hence the surface temperatures of the metallic cleaning rollers become close to the set temperatures of the heating member and the pressing member, exceeding the melting temperature of the developer. The cleaning rollers are put in contact with the heating member and the pressing member so as to remove the leftover developer by adhering the developer to the surfaces of the cleaning rollers.

Since the surface of the cleaning roller is formed with projected and indented configurations so as to correspond to the positions where the leftover toner is prone to build up, it is possible to remove the leftover developer intensively.

Accordingly, it is possible to positively remove the leftover developer on the heating member or the pressing member of the fixing unit to thereby reliably prevent the front and rear surfaces of the recording paper from being dirtied, hence this configuration is markedly effective in improving the quality of the image formed on the recording paper.

While peripheral devices such as multiple paper separation claws, temperature detecting sensor or the like, are arranged on the peripherals sides of the heating member or the pressing member, projected and indented configurations are formed on the peripheral sides of the cleaning roller so that the projected portions are formed at positions corresponding to the positions where the aforementioned peripheral devices are arranged. Accordingly, it is possible to remove the leftover developer by the cleaning roller from the portions corresponding to the peripheral devices where the leftover developer is prone to build up on the heating member or the pressing member. As a result, the leftover developer can be removed in a more reliable manner from where the toner is prone to stagnate, hence making it possible to improve the quality of images formed on the recording paper.

The aforementioned cleaning roller can be laid out on the upstream side of the positions of the multiple paper separation claws arranged on the periphery of the heating member or the pressing member, with respect to the direction of surface movement of the heating member or the pressing member. Accordingly, despite the fact that the leftover developer is prone to build up at the positions where the multiple paper separation claws are arranged on the periphery of the heating member or pressing roller because these elements are disposed in proximity to or in sliding contact with the heating member or pressing member, the above configuration makes it possible to efficiently and positively remove the leftover toner by the cleaning rollers before the toner builds up around the multiple paper claws.

It is also possible to arrange the cleaning roller on the upstream side of the position of the temperature detecting sensor laid out on the periphery of the heating member or pressing member, with respect to the direction of surface movement of the heating member or the pressing member. The leftover developer is prone to build up at the position where the temperature detecting sensor is arranged on the periphery of the heating member or the pressing member because it is put in proximity to or in sliding contact with the heating member or the pressing member, however the above configuration makes it possible to positively and efficiently remove the leftover toner by the cleaning roller before the toner builds up around the temperature detecting sensor.

The cleaning rollers are driven following the drive for the heating member and the pressing member, so no special driver for the cleaning rollers is needed. Accordingly, it is possible to simply configure a fixing unit without making its overall configuration complicated. Further, the heating member or the pressing member can be easily driven in synchronization.

DESCRIPTION OF THE PREFERRED EMBODIMENTS

Referring next the drawings shown in FIGS. 1 to 5, the embodiment of a drive control devices of drive rollers of an image forming apparatus will be described in detail.

Figure 1:
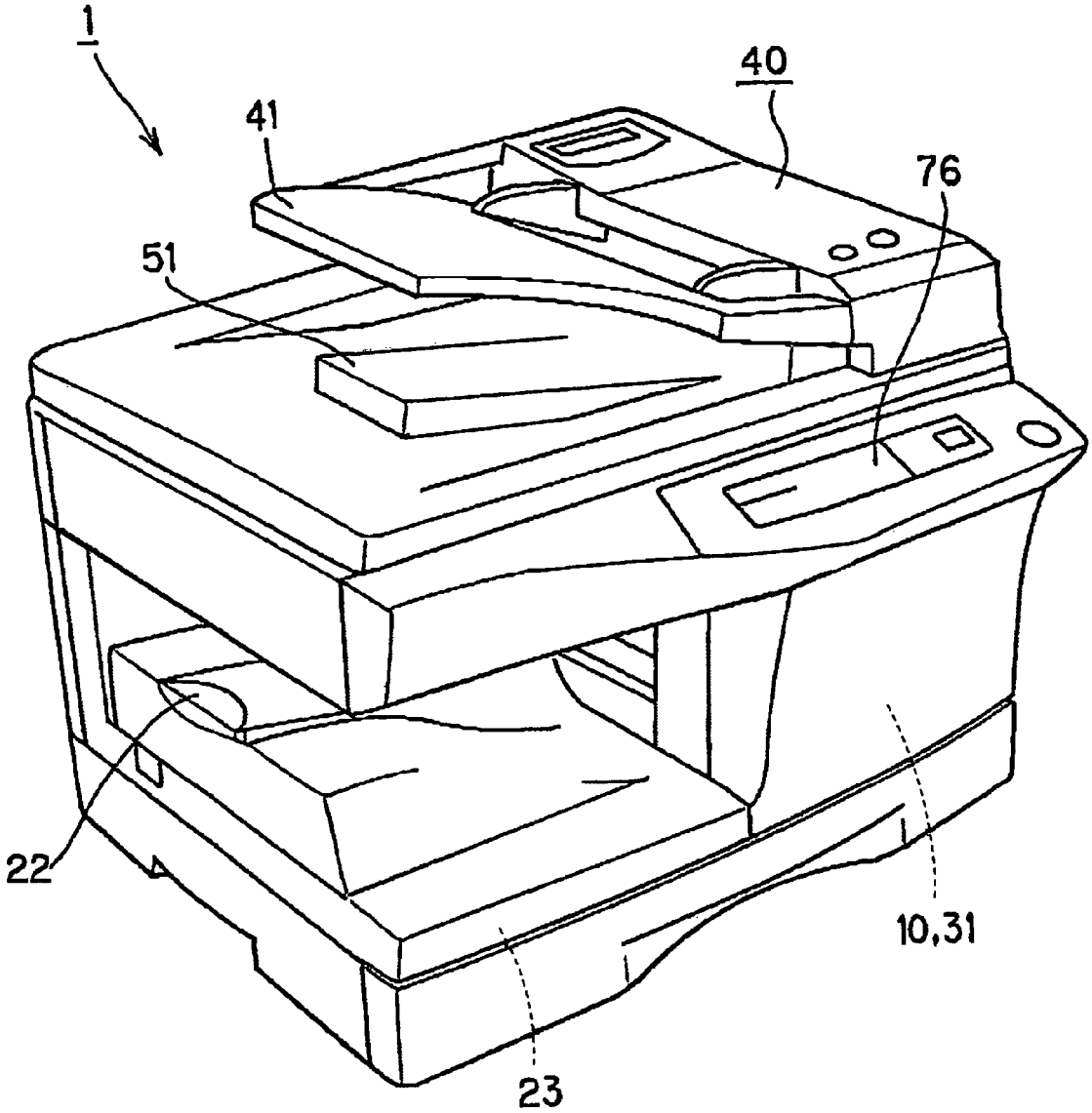
FIG. 1 shows an overall external configuration of an image forming apparatus according to the embodiment of the present invention.
Figure 2:
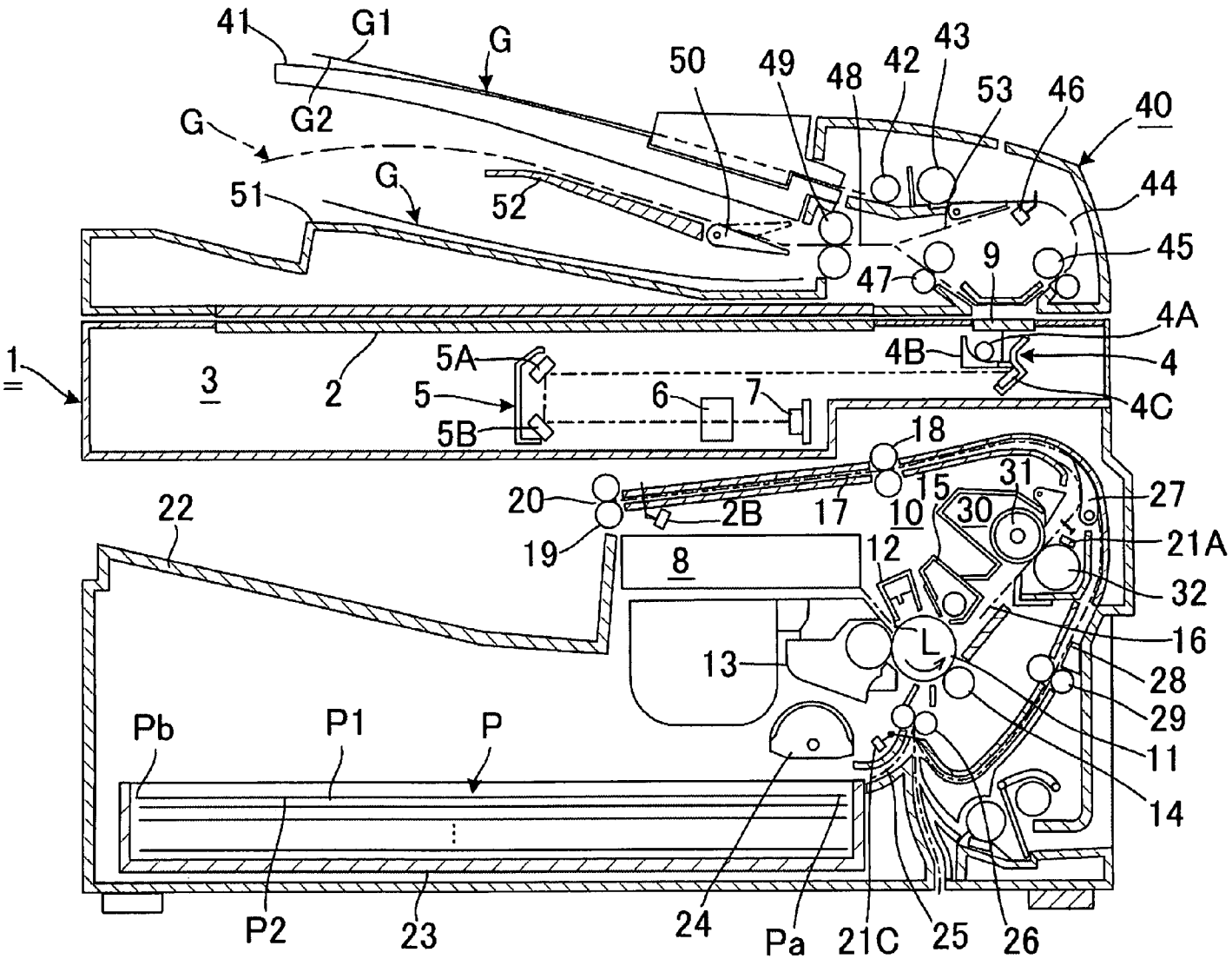
FIG. 2 is a vertical sectional illustrative view showing the internal structure of the image forming apparatus of FIG. 1.
Figure 3:
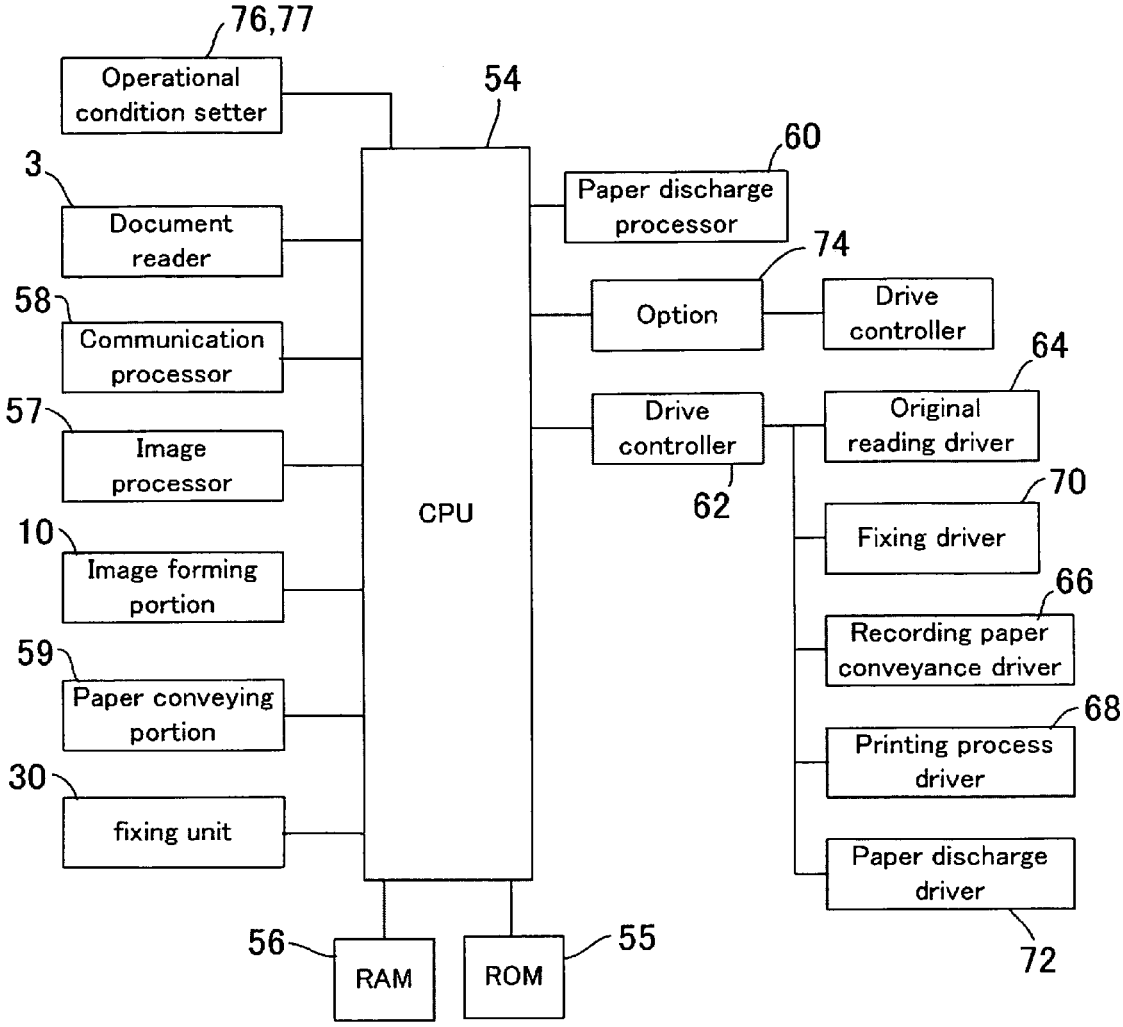
FIG. 3 shows control blocks in the electric control system of the image forming apparatus of FIG. 1.

FIG. 1 shows an overall external configuration of an image forming apparatus according to the embodiment of the present invention; FIG. 2 shows the internal structure of the image forming apparatus; and FIG. 3 shows control blocks in the electric control system of the image forming apparatus. In the drawings, a reference numeral 1 designates a main apparatus body (machine body).

As shown in FIGS. 1 to 3, an original placement table 2 made of transparent glass, on which an original is placed, is provided on the top of the main apparatus body 1. A scanner portion 3 as a document reader for capturing image information of an original G is arranged under the original placement table 2.

[Scanner Portion 3]

Scanner portion 3 is composed of an original image reading unit including a first scan unit 4 and a second scan unit 5 that are arranged under original placement table 2 and reciprocate in parallel thereto, and an optical lens element 6; a photoelectric transducer (CCD) 7. In FIG. 2, the light path in scanner portion 3 is shown by the chain line.

First scan unit 4 includes an exposure lamp 4A, a reflector 4B for guiding the light from exposure lamp 4A to the original image surface and a first mirror 4C for leading the reflected light image that is obtained by exposing the original via reflector 4B and being reflected off the original, in a predetermined direction, and is controlled so as to move back and forth at a predetermined scan speed, keeping itself parallel to and a predetermined distance from, the underside of original placement table 2.

Second scan unit 5 includes a second mirror 5A and a third mirror 5B for leading the reflected light image from the original by way of first mirror 4C of first scan unit 4 in the predetermined direction and is controlled so as to move back and forth parallel to the first scan unit 4 and at a speed related to the speed of the first scan unit 4.

Optical lens element 6 is laid out on the light path of the reflected light from the original image, lead by third mirror 5B of second scan unit 5 so that the light image is focused on photoelectric transducer 7.

This photoelectric transducer (e.g., CCD (charge coupled device)) 7 captures the light image of the original image, focused by optical lens element 6 and photoelectrically converts it into an electric signal to thereby create original image information (original image data). This original image information is output to an image processing portion 57.

[Image Processing Portion 57]

Image processing portion 57 subjects the original image information output from photoelectric transducer 7 to image processes and produces printing image information (printing image data) so that the resolution, density, etc., will be suited for printing. The printing image information obtained as a result of the image processes is sent to the image data input portion of a laser scanning unit (LSU) 8.

[Image Forming Portion 10]

Then, laser scanning unit 8 emits laser beams in accordance with the printing image information output from image processing portion 57 over the surface of photoreceptor drum 11 as a constituent of image forming portion (image forming process) 10. In this way, an electrostatic latent image of the printing image information is written and formed on photoreceptor drum 11.

Photoreceptor drum 11 is rotationally driven in the direction of the arrow. Arranged around photoreceptor drum 11 are a main charger 12 for charging the photoreceptor drum 11 surface at a predetermined potential, laser scanning unit 8 for emitting laser beams for forming an electrostatic latent image on the photoreceptor drum 11 surface, a developing unit 13 for developing the electrostatic latent image formed by illumination of the laser beams from laser scanning unit 8 with a toner (developer), a transfer roller 14 for transferring the toner image of the original image that has been visualized by the developing unit 13 to a recording paper (also called "print paper") P fed through a paper feed path 25 from a paper feed cassette 23 detailed later, and a cleaning member 15 made of a cleaning blade for removing and cleaning the leftover toner remaining on the photoreceptor drum 11 after the transfer with transfer roller 14, all being arranged in the rotational direction of photoreceptor drum 11 in the order mentioned.

Main charger 12 of image forming portion 10 also has the function of unillustrated charge erasing device for erasing charge on the photoreceptor drum 11 surface after cleaning by cleaning member 15.

The recording paper P with a toner image transferred thereon as it being nipped between the photoreceptor drum 11 and transfer roller 14, is separated from the photoreceptor drum 11 surface and further conveyed along a main conveyance path 16 into the nip between a heat roller (heating member) 31 and a pressing roller (pressing member) 32 in a fixing unit 30.

[Fixing Unit 30]

Figure 4:
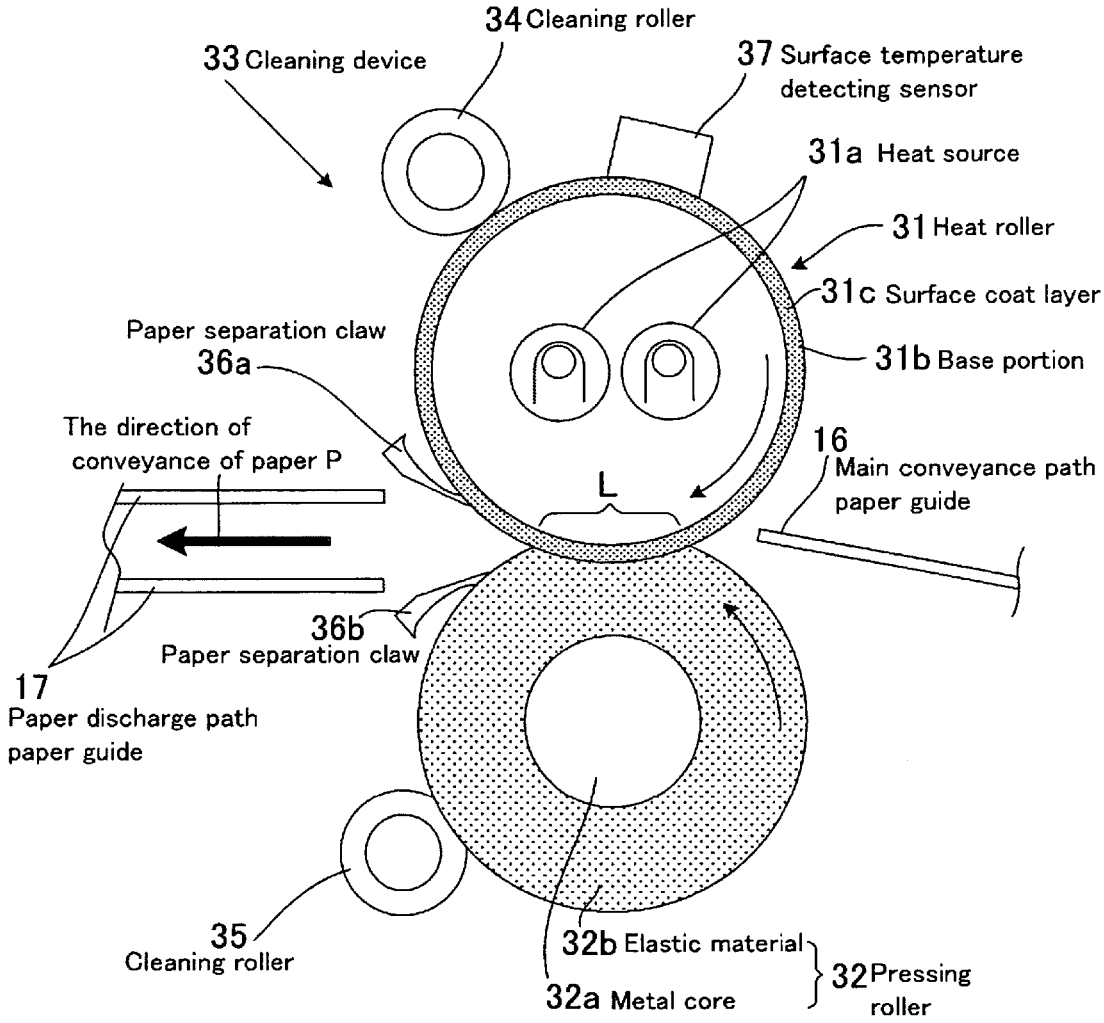
FIG. 4 is a detailed view showing a fixing unit made up of a heat roller and a pressing roller, viewed from their axial direction.
Figure 5:
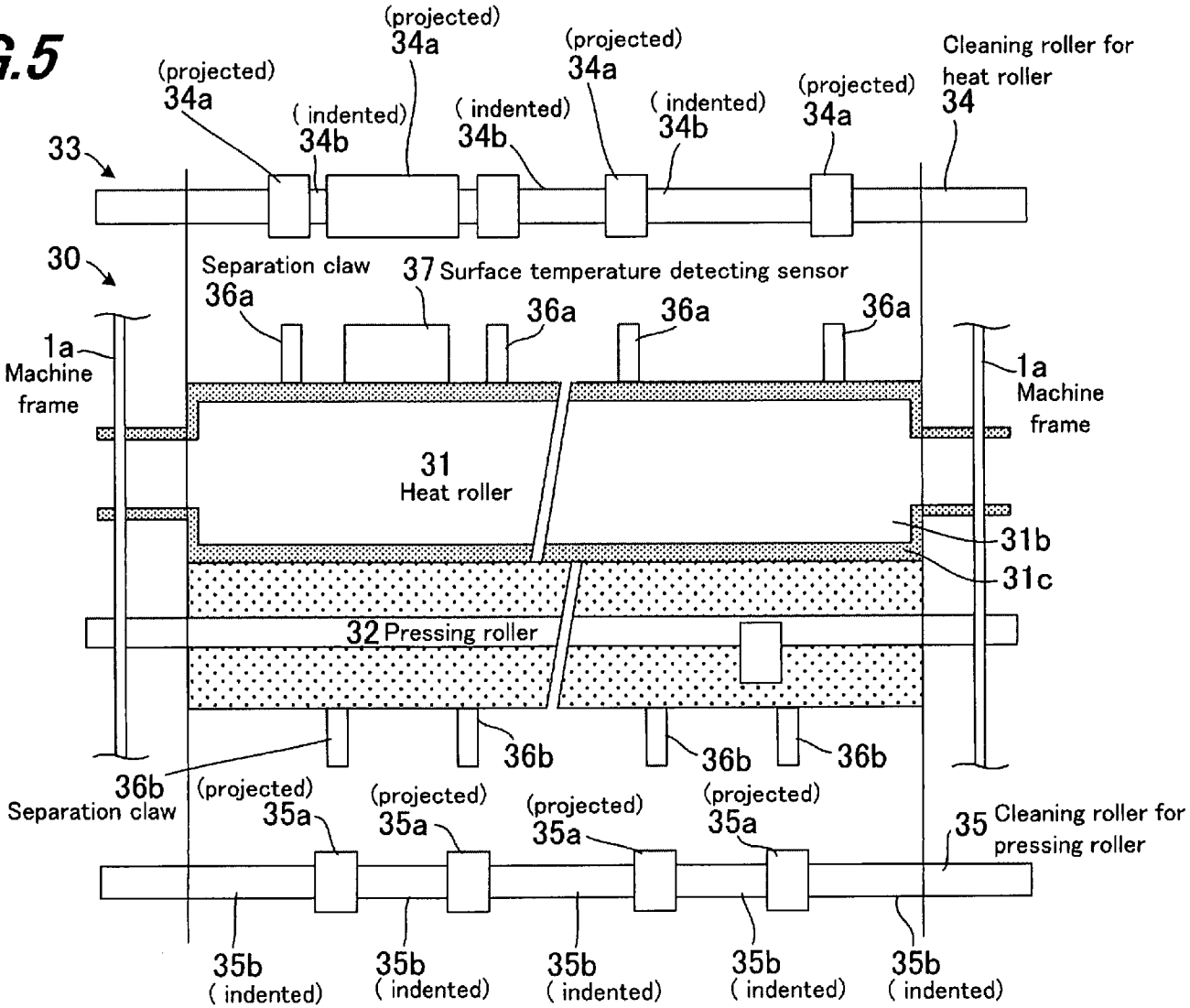
FIG. 5 is an illustrative, partly exploded view showing in detail a cleaning device of a fixing unit.

FIG. 4 is a detailed view showing fixing unit 30 made up of heat roller 31 and pressing roller 32, viewed from their axial direction, and FIG. 5 is an illustrative, partly exploded view showing in detail a cleaning device 33 of fixing unit 30. Based on these drawings, fixing unit 30 and its cleaning device 33 will be described in detail.

Fixing unit 30 includes heat roller 31 and pressing roller 32 that comes in press-contact with heat roller 31, and passes the recording paper P with an unfixed toner image formed thereon through the nip between the heat roller 31 and pressing roller 32 to thereby fix the toner image to the recording paper P by applying heat and pressure thereto.

Heat roller 31 is formed of a hollow cylindrical base portion 31*b* made of metal such as aluminum etc. and incorporating a heater (heat source) 31*a* of a heater lamp and a thin-film coat layer 31*c*, made of a resin having separability etc., (having a thickness equal to or smaller than one-tenth of the total thickness), laminated over the outer surface of the base portion 31*b*.

Pressing roller 32 is formed of a metal core 32*a* having a relatively small diameter (about one half to one third of the total thickness) and an elastic material 32*b* made of silicone rubber (which may be made of other rubber or elastomer having heat resistance) that can present the predetermined elasticity necessary for forming an after mentioned nip portion, formed over the outer periphery of metal core 32*a*.

Heat roller 31 and pressing roller 32 are arranged and set up so as to press each other with a predetermined pressing force and so that the surface of elastic material 32*b* of pressing roller 32 deforms to form a nip portion at their contact to each other. Heat roller 31 and pressing roller 32 can be set in a position adjustable manner to, and are axially supported by a frame 1*a* of main apparatus body 1 so that they can rotate. As shown in FIG. 4, the nip portion is formed in the range designated by a symbol L.

Fixing unit 30 performs fixing of an unfixed toner image transferred from the photoreceptor drum 11 to the recording paper P that is held by the nip portion or between heat roller 31 and pressing roller 32, under application of heat from heat roller 31 and pressure from heat roller 32 (since the nip portion is created with a width, designated by L, along the peripheral direction of heat roller 31, heat roller 31 and pressing roller 32 abut each other in area contact rather than line contact so as to be able to apply heat and pressure to recording paper P by heat roller 32 and pressing roller 32 of some duration).

This fixing unit 30 is provided with cleaning device 33 for removing the toner remaining on heat roller 31 and pressing roller 32.

Cleaning device 33 is composed of cleaning rollers 34 and 35 made of metal that come into press-contact with the heat roller 31 and pressing roller 32, respectively. The axial directions (longitudinal directions) of cleaning rollers 34 and 35 are arranged parallel to the axial directions (longitudinal directions) of heat roller 31 and pressing roller 32. These cleaning rollers 34 and 35 each have indented and projected surface configurations.

Specifically, cleaning rollers 34 and 35 are shaped in indentations and projections along the axial direction, forming large-diametric projected portions 34*a* and 35*a* and small-diametric indented portions 34*b* and 35*b*.

As the peripheral devices on the heat roller 31 and pressing roller 32 in the embodiment, multiple number of paper separation claws (also called "paper peeling claws") 36*a* and 36*b* in contact or proximity with the peripheries of heat roller 31 and pressing roller 32 are arranged across the lengths of heat roller 31 and pressing roller 32.

Paper separation claws 36*a* and 36*b* provide the function of peeling off the recording paper P if the paper sticks to and winds around the rollers while passing through the nip between heat roller 31 and pressing roller 32, or prevent the paper from winding and facilitate the paper to advance along the paper guide in a paper discharge path 17. Paper separation claws 36*a* and 36*b* have an essentially wedge-shape or tongue-like shape, and are arranged at approximately the same position (approximately the same distance) from the end of nip portion L, with respect to the peripheral directions of heat roller 31 and pressing roller 32. Further, paper separation claws 36*a* and 36*b* are disposed at multiple positions at intervals with respect to the axial direction of heat roller 31 and pressing roller 32.

It should be added that provision of paper separation claws (36*a* and 36*b*) for only one of heat roller 31 or pressing roller 32, as necessary, falls within the scope of the present invention.

As other peripheral devices, a temperature detecting sensor 37 of a thermistor is arranged in contact with or in proximity with the outer periphery of heat roller 31.

In the fixing unit, heat lamp (heat source) 31*a* is turned on and off based on the detected temperature of temperature detecting sensor 37, so as to keep heat roller 31 at a predetermined target temperature (set temperature).

Here, providing another temperature detecting sensor 37 for pressing roller 32, as necessary, also falls with the scope of the present invention.

The indented and projected configurations (large-diametric portions 34*a* and 35*a* and small-diametric portions 34*b* and 35*b*) on the outer peripheral surfaces of cleaning rollers 34 and 35 are formed so that the projected portions, i.e., large-diametric portions 34*a* and 35*a* are essentially positioned so as to correspond to the positions of paper separation claws 36*a* and 36*b* of heat roller 31 and pressing roller 32 and the positions of the peripheral devices such as temperature detecting sensor 37 of heat roller 31 and the like, with respect to the direction of the rotational axes of the respective rollers.

The cleaning rollers 34 are disposed downstream of the positions of multiple paper separation claws 36*a* and 36*b* on the peripheries of heat roller 31 and pressing roller 32 with respect to the respective directions (the direction of surface movement) of rotation of heat roller 31 and pressing roller 32.

Further, cleaning roller 34 is disposed upstream of the position of temperature detecting sensor 37 on the periphery of heat roller 31 with respect to the direction of surface movement of heat roller 31.

Cleaning rollers 34 and 35 rotate following the respective drives of heat roller 31 and pressing roller 32.

Recording paper P after fixing by this fixing unit 30 is conveyed through paper discharge path 17 toward a paper discharge roller 19 on the paper discharge port 20 side by a paper discharge drive roller 18.

[Paper Discharge Processor 60]

Recording paper P conveyed through paper discharge path 17 is detected by a fixing detection switch 21A arranged downstream of fixing unit 30 when the paper passes through the nip between heat roller 31 and pressing roller 32.

For a case of usual one-sided printing, the paper is directly conveyed by the rotational drives of paper discharge drive roller 18 and a paper discharge roller 19 and discharged through paper discharge port 20 onto a paper output cassette 22 which is disposed in a space under scanner portion 3. The passage status of recording paper P on paper discharge roller 19 is detected by a paper discharge detecting switch 21B arranged upstream of paper discharge roller 19.

Recording paper P is conveyed from the side of the image forming portion 10 and discharged to the space over paper feed cassette 23 and under scanner portion 3.

[Paper Conveying Portion 59]

Arranged at the inner bottom of main apparatus body 1 is an exchangeable paper feed cassette 23, in which an each stack of recording paper P of a predetermined paper size is accommodated. A crescent-shaped sheet pickup roller 24 is arranged over the paper outputting side of this paper feed cassette 23.

This paper pickup roller 24 picks up the paper, sheet by sheet, from the topmost of a stack of recording paper P1 in paper feed cassette 23 and conveys the paper downstream (for convenience sake, the delivery side of recording paper P1 (the cassette side) is referred to as upstream and the direction of discharging is referred to as downstream) to a registration roller (also called "idle roller") 26 in paper feed path 25.

Arranged on the upstream side of registration roller 26 is a pre-registration detection switch 21C. This pre-registration detection switch 21C detects recording paper P that is fed and conveyed from paper feed cassette 23. Paper feed to the aforementioned image forming portion 10 is adapted to be performed by adjusting the paper feed timing based on this signal.

On the other hand, when duplex printing is performed, after printing by image forming portion 10 has been performed on one side of recording paper P, the recording paper P is sent into paper discharge path 17 after passage through fixing unit 30, then once conveyed to the paper discharge roller 19 side. In this condition, a paper switching gate 27 is changed over, then paper discharge roller 19 is driven in reverse so that the recording paper P is switched back and guided into sub conveyance path 28 for reversing the paper.

Then, the thus guided recording paper P is rotationally driven by a sub-drive roller 29 provided on this sub conveyance path 28 and conveyed to the upstream side of registration roller 26, so that printing on the other side of recording paper P is performed.

On original placement table 2 of main apparatus body 1 an automatic document processor 40 of a document feed type reversing automatic document feeder (R-SPF), for example, is mounted so that it can be opened and closed to also serve as an original placement cover.

As shown in FIG. 2, this automatic document processor 40 has a document tray 41 on which originals G are set. Then, the originals G set on this document tray 41 are picked up, one by one, by a document pickup roller 42 so that original G is guided by a document drive roller 43 through a document conveyance path 44 and conveyed to the upstream side of a registration roller (PS roller) 45.

A document input sensor 46 for detecting the document size of original G is arranged on the upstream side of the registration roller 45. This document input sensor 46 detects the leading end and trailing end of original G. Conveyance of original G to a document reading station 9, formed of a glass slit and arranged adjacent to one side of document placement table 2, is controlled by adjusting the conveying timing based on the detection of this signal.

In this case, movement of first scan unit 4 of scanner portion 3 is controlled so that it is positioned ready to go under document reading station 9.

As to the scan of original G that is fed onto this document reading station 9, one side of the original, namely, the first image-scan side G1 is scanned by first scan unit 4 of scanner portion 3 while the original is being moved. Other operations such as image reading by photoelectric transducer 7, the image processing of the image information, the image forming process including printing etc., are performed in the same manner as above.

The original G that has been scanned through document reading station 9 is conveyed by a conveyance roller 47 through document discharge path 48 toward the document discharge roller 49 side. When document reading is performed for one side only, the document is discharged onto a document output tray 51 by the switching control of a document switching gate 50.

On the other hand, when document reading is performed for both sides, by the switching control with document switching gate 50 original G is once discharged onto a middle tray 52 disposed between document tray 41 and document output tray 51, then is switched back into a document reversing path 53 by driving document discharge roller 49 in reverse. This original G is once again fed into document conveyance path 44 so that the original image on the underside of original G facing the image reader is scanned while the original image on the underside of original G is printed out on the first printing side of recording paper P1 in the same manner as in the above-described one-side printing operation.

When this printing operation for the first printing side of recording paper P1 has been finished, recording paper P is reversed by the above-described sheet reversing device, then fed again into image forming portion 10 so that the original image on the front side of original G that has been previously stored in the memory is printed on the second printing side P2.

As shown in FIG. 1, control switches 76 for allowing the user to set up the image forming conditions such as sheet type of recording paper P (sheet thickness etc., in addition to sheet size), print number, magnification, density etc., are arranged on the front portion on the upper side of the image forming apparatus.

Referring next to FIG. 3, the control system of the image forming apparatus according to the embodiment will be described.

As shown in FIG. 3, the image forming apparatus according to the embodiment performs processes such as image reading, image processing, image forming and conveyance of recording paper P, etc., by a central processing unit (CPU) 54 which performs control in accordance with the program stored beforehand in a ROM (read only memory) 55, using temporal storage such as a RAM (random access memory) 56 etc. It is also possible to use other storage such as a HDD (hard disk drive) etc., instead of ROM and RAM.

In the image forming apparatus, the image information of an original(original image data) captured by scanner portion (original reading portion) 3, or original image information transmitted from other terminal devices connected via an unillustrated communication network, is adapted to be input to an image processing portion 57 by way of a communication processor 58.

Image processor 57 shapes the original image information stored in the storage such as RAM 56 or the like into a printing image that is suitable for printing (image forming onto recording paper), in accordance with the aforementioned program.

The printing image information is input to image forming portion 10.

Image forming portion 10, paper conveying portion (performing various detections and controls of recording paper P in paper feed path 25, main conveyance path 16, sub conveyance path 28 (these are also called paper guides)) 59, fixing unit 30 and paper discharge processor (performing various detections and controls of recording paper P in paper discharge path 17) 60 are linked with respective drive controllers.

Paper conveying portion 59 conveys recording paper P so through a printing stage (printing process of image information in image forming portion 10) and a fixing stage (at fixing unit 30) for the recording paper P having been processed with printing and then discharges it to paper discharge portion (paper output cassette 22). Here, paper conveying portion 59 receives detection signals from the aforementioned pre-registration detection switch 21C, fixing detection switch 21A and paper discharge detecting switch 21B.

The image forming apparatus has an operational condition setter 77. This operational condition setter 77 sets up operational conditions for image forming and conditions of conveyance etc., in the image forming apparatus, in accordance with the image forming request and the image forming conditions such as the type of recording media etc., designated by the user through control switches 76.

Further, in the image forming apparatus, based on the set operating conditions, drive controller 62 is adapted to control drive actuators for the aforementioned reading portion (scanner portion 3), paper conveying portion 59, image forming portion 10, fixing unit 30, paper discharge processor 60 etc., namely, an original reading driver 64, a recording paper conveyance driver 66, a printing process driver 68, a fixing driver 70 and a paper discharge driver 72 so that they can operate in synchronization with instructions from CPU 54 in accordance with the program stored in ROM 55.

Original reading driver 64 is a drive actuator for the first scan unit 4 and the second scan unit 5 of scanner portion 3.

Recording paper conveyance driver 66 means paper conveying portion 59, specifically, drive motors for paper pickup roller 24 and registration roller 26 along the aforementioned paper feed path 25. Printing process driver 68 is a drive motor for photoreceptor drum 11. Fixing driver 70 is of drive motors for heat roller 31 and pressing roller 32 in fixing unit 30. Paper discharge driver 72 is of drive motors for paper discharge drive roller 18, paper discharge roller 19 etc. All drive motors of these drivers may be driven by common or different motors with appropriate power transmission mechanisms.

Further, the image forming apparatus may be used with optional configurations 74 including post-processors (stapler, puncher, multi-bin paper output trays, shifter, etc.), automatic document reader (automatic document processor 40 etc.), large-volume paper feed cassettes and the like. These optional configurations 74 incorporate individual controllers separately from the controller of the image forming apparatus so as to operate in synchronization with the main apparatus by performing timing adjustment via the aforementioned communication processor 58.

According to cleaning device 33 of fixing unit 30 in the present embodiment, metallic cleaning rollers 34 and 35 are arranged in press-contact with heat roller 31 and pressing roller 32 of fixing unit 30. In this case, heat from heater lamp (heat source) 31*a* transfers from the heat roller 31 surface to cleaning roller 34, and also from the heat roller 31 surface via pressing roller 32 surface to cleaning roller 35, hence the surface temperatures of the metallic cleaning rollers 34 and 35 become close to the set temperatures of heat roller 31 and pressing roller 32, exceeding the melting temperature of the developer. Cleaning rollers 34 and 35 are put in contact with heat roller 31 and pressing roller 32 so as to remove the leftover toner (leftover developer) by adhering the toner to the surfaces thereof.

The principle of this toner removal will be described. When the toner used as the developer has a softening temperature of 60 to 80 deg. C. and a melting point of 130 to 180 deg. C., the surface temperature of heat roller 31 is set at 180 to 210 deg. C. Heat transfers from heat roller 31 to pressing roller 32, but the temperature should be lower than that of heat roller 31. Since cleaning rollers 34 and 35 are made of metal, they hence have good thermal conductivity and thermal radiativity, the temperature of cleaning rollers 34 and 35 become much lower than that of rollers 31 and 32 in contact with them. As the toner transfers from heat roller 31 and pressing roller 32 to cleaning rollers 34 and 35, the toner, if it is molten, will solidify on the cleaning rollers 34 and 35 and be collected in a non-molten form.

The toner transferred to and collected by cleaning rollers 34 and 35 moves in the axial directions of rollers thereon by being pushed out by the contact pressure between heat roller 31 and cleaning roller 34 and by the contact pressure between pressing roller 32 and cleaning roller 35. As the thus moving toner reaches the edges of the projections of cleaning rollers 34 and 35, the toner peels off and falls so that the toner is removed from cleaning rollers 34 and 35, without stagnating thereon.

Since the surfaces of cleaning rollers 34 and 35 are formed with projected and indented configurations (formed of large diametric portions 34*a* and small-diametric portions 34*b* on roller 34 and formed of large diametric portions 35*a* and small-diametric portions 35*b* on roller 35) correspondingly to the positions where the leftover toner builds up, it is possible to remove the leftover developer intensively from where the toner is prone to stay.

Accordingly, it is possible to suitably and positively remove the leftover developer on heat roller 31 or pressing roller 32 of fixing unit 30 to thereby reliably prevent the front and rear surfaces of recording paper P from being dirtied, and hence improve the quality of images formed on recording paper P.

While peripheral devices such as multiple paper separation claws 36*a* and 36*b* are arranged on the peripherals sides of heat roller 31 and pressing roller 32, and temperature detecting sensor 37 etc. on the peripheral side of heat roller 31, projected and indented configurations are formed on the peripheral sides of cleaning rollers 34 and 35 so that the projected portions are formed at positions corresponding to the positions where the aforementioned peripheral devices are arranged. Accordingly, it is possible to remove the leftover developer by cleaning rollers 34 and 35 from the portions corresponding to the peripheral devices where the leftover developer is prone to build up on heat roller 31 or pressing roller 32.

As a result, the leftover developer can be removed in a more reliable manner from where the toner is prone to stagnate, hence making it possible to improve the quality of the image formed on recording paper P.

The aforementioned cleaning rollers 34 and 35 are laid out on the downstream side of the positions of multiple paper separation claws 36*a* and 36*b* arranged on the peripheries of heat roller 31 and pressing roller 32, with respect to the direction of surface movement of heat roller 31 and pressing roller 32. Accordingly, despite the fact that the leftover developer is prone to build up at the positions where multiple paper separation claws 36*a* or 36*b* are arranged on the periphery of heat roller 31 or pressing roller 36 because these elements are disposed in proximity to or in sliding contact with these roller 31 or 32, the above configuration makes it possible to efficiently remove the leftover toner by cleaning rollers 34 and 35 before the toner builds up around multiple paper claws.

It is also possible to arrange the cleaning roller 34 on the upstream side of the position of temperature detecting sensor 37 laid out on the periphery of heat roller 31, with respect to the direction of surface movement of the heat roller 31. The leftover developer is prone to build up at the position where temperature detecting sensor 37 is arranged on the periphery of heat roller 31 because it is put in proximity to or in sliding contact with the roller 31, however the above configuration makes it possible to positively and efficiently remove the leftover toner by cleaning roller 34 before the toner builds up around the temperature detecting sensor 37.

The cleaning rollers 34 and 35 are driven following the drive for the heat roller 31 and pressing roller 32, so no special drivers for cleaning rollers 34 and 35 are needed. Accordingly, it is possible to simply configure a fixing unit without making its overall configuration complicated. Further, heat roller 31 or pressing roller 32 can be easily driven in synchronization.

The cleaning device for a fixing unit of the present invention should not be limited to the above embodiment, and various changes and modifications can be of course added without departing from the scope of the present invention. In the present embodiment, temperature detecting sensor 37 is provided on heat roller 31, but the sensor may be arranged on pressing roller 32 while a large-diametric projected portion can be formed in cleaning roller 35 at the position corresponding to the sensor.

As the peripheral devices, other devices or members from which the leftover developer should be removed, other than paper separation claws and temperature detecting sensor, may be provided. In this case, formation of projections and indentations in the cleaning rollers at the positions corresponding to the devices or members of course falls within the scope of the present invention.

The invention claimed is:

1. A cleaning device for a fixing unit in an electrophotographic image forming apparatus, the fixing unit being formed of a heating member incorporating a heater and a pressing member that is put in press-contact with the heating member to fix an unfixed developer image formed on the surface of recording paper thereto by applying heat and pressure as the paper is passed through a nip between the heating member and pressing member, the cleaning device for removing the developer remaining on at least one of the heating member and pressing member in the fixing unit, comprising:

a cleaning roller arranged in press-contact with at least one of the heating member and pressing member, a surface of the cleaning roller having annular projected shapes and annular indented shapes, wherein peripheral devices, including a plurality of paper separation claws and a temperature detecting sensor, are arranged adjacent a peripheral surface of the heating member or pressing member, wherein the annular projected shapes are at positions on the surface of the cleaning roller aligned, in a direction of rotation of the heating member or pressing member, with the peripheral devices, wherein the cleaning roller is laid out on a downstream side of the multiple paper separation claws adjacent the peripheral surface of the heating member or pressing member, wherein the downstream side is with respect to a direction of surface movement of the peripheral surface of the heating member or the pressing member, wherein the cleaning roller is laid out on an upstream side, in the direction of the surface movement of the peripheral surface of the heating member or pressing member, and wherein the annular indented shapes are at reduced diameter sections of the cleaning roller that do not abut the heating member or pressing member, and the annular indented shapes are opposite to annular surfaces of the heating member or pressing member that do not abut the peripheral devices.

2. The cleaning device for a fixing unit according to claim 1, wherein the cleaning roller is driven following a drive for the heating member and pressing member.

3. A cleaning device for a fixing unit in an electrophotographic image forming apparatus, the fixing unit being formed of a heating member incorporating a heater and a pressing member that abuts the heating member to fix an unfixed developer image formed on the surface of recording paper thereto by applying heat and pressure as the paper is passed through a nip between the heating member and the pressing member, and peripheral devices are each adjacent a respective annular region of a peripheral surface of the heating member or the pressing member, and the cleaning device for removing the developer remaining on at least one of the heating member and pressing member in the fixing unit, wherein the cleaning device comprises:

a cleaning roller adjacent the heating member or pressing member, a surface of the cleaning roller having annular projected shapes and annular indented shapes, wherein the annular projected shapes are each aligned with one of the annular regions of the peripheral surface of the heating member or pressing member, and the annular indented shapes are aligned with other annular regions of the peripheral surface that are not aligned with the peripheral devices.

* * * * *